US011484932B2

(12) United States Patent
Konka et al.

(10) Patent No.: US 11,484,932 B2
(45) Date of Patent: Nov. 1, 2022

(54) TOOL FOR ENHANCED ACCURACY IN DOUBLE-SIDED INCREMENTAL FORMING

(71) Applicant: The Boeing Company, Chicago, IL (US)

(72) Inventors: Praveen Konka, Telangana (IN); Venkata Reddy Nallagundla, Telangana (IN); Om Prakash, Karnataka (IN); Megha Sahu, Karnataka (IN)

(73) Assignee: THE BOEING COMPANY, Chicago, IL (US)

( * ) Notice: Subject to any disclaimer, the term of this patent is extended or adjusted under 35 U.S.C. 154(b) by 21 days.

(21) Appl. No.: 16/778,005

(22) Filed: Jan. 31, 2020

(65) Prior Publication Data

US 2021/0237140 A1 Aug. 5, 2021

(51) Int. Cl.
*B21D 31/00* (2006.01)
*B21D 37/10* (2006.01)

(52) U.S. Cl.
CPC ..... *B21D 31/005* (2013.01)

(58) Field of Classification Search
CPC ..... B21D 31/005; B21D 37/16; B23B 49/003
See application file for complete search history.

(56) References Cited

U.S. PATENT DOCUMENTS 3,126,793 A * 3/1964 Jennings ..... B23B 49/003 409/125
5,277,526 A * 1/1994 Corsi ..... B23B 49/02 408/124
7,607,871 B1 * 10/2009 Nelson ..... B23B 31/20 408/202
9,421,598 B2 8/2016 Baud et al.
2005/0229666 A1 10/2005 Toeniskoetter
2010/0199742 A1 8/2010 Johnson et al.
2014/0345351 A1 11/2014 Roth et al.
2014/0366600 A1 * 12/2014 Kozaki ..... B21D 5/0209 72/21.4

(Continued)

FOREIGN PATENT DOCUMENTS

CN 101306451 A * 11/2008 ..... B21D 31/005
CN 103639249 B 7/2016

(Continued)

OTHER PUBLICATIONS

English translate (CN101306451A), retrieved date Sep. 1, 2021.*

(Continued)

*Primary Examiner* — Jessica Cahill
*Assistant Examiner* — Mohammed S. Alawadi
(74) *Attorney, Agent, or Firm* — Coats & Bennett, PLLC

(57) ABSTRACT

A tool for use during double sided incremental forming of a workpiece. The tool includes a sleeve with a hollow interior space. A contact member is positioned within the hollow interior space of the sleeve. The contact member is sized with a working tip positioned outward beyond the sleeve to contact against a workpiece. A mount is positioned on the opposing end of the sleeve and configured to connect to a tool holder. The tool is configured to provide for translational and/or rotational movement of the contact member. The axial and rotational movement provides for the working tip to remain in contact with the workpiece during the forming process.

20 Claims, 8 Drawing Sheets

(56) References Cited

U.S. PATENT DOCUMENTS

| | | | | |
|---|---|---|---|---|
| 2018/0126534 | A1* | 5/2018 | Iida | B25F 5/02 |
| 2019/0308236 | A1* | 10/2019 | Ishihara | B21D 11/22 |

FOREIGN PATENT DOCUMENTS

| | | | |
|---|---|---|---|
| CN | 110369853 | A | 10/2019 |
| DE | 102013110855 | A1 | 4/2015 |
| EP | 2505279 | A1 | 10/2012 |
| WO | 2007138173 | A1 | 12/2007 |

OTHER PUBLICATIONS

Northwestern University, Incremental Forming Methodology, Double-Sided Incremental Forming, 2015, pp. 1-4, Retrieved from the internet: URL: http://ampl.mech.northwestern.edu/research/current-research/incremental-forming-methodology.html [retrieved on Jan. 31, 2020]; pp. 1-4.

Xu, D.K., et al., "Enhancement of process capabilities in electrically-assisted double sided incremental forming", Materials and Design, Dec. 8, 2015, pp. 268-280, vol. 92, XP029384818.

EP Search Report dated Jun. 24, 2021 in re EP Application No. 21151695.0.

* cited by examiner

TOOL FOR ENHANCED ACCURACY IN DOUBLE-SIDED INCREMENTAL FORMING

TECHNOLOGICAL FIELD

The present disclosure relates generally to the field of forming tools and, more specifically, to a forming tool that maintains a working tip of the tool against a workpiece during a forming process.

BACKGROUND

Double sided incremental forming is a process for forming relatively thin sheets of material, such as sheet metal. The process includes two tools each having a tip with one of the tools being a support tool and the other tool being a forming tool. The first tool contacts the workpiece on a first side and the second tool contacts the workpiece on an opposing second side. The tools move together such that the tips are aligned or offset on the opposing sides of the sheet. The two tools move their respective tips along a preprogrammed path to form the workpiece and generate the desired part. Roles of the two tools can be interchanged to form features on both sides of the sheet without any additional setup.

The accuracy of the forming process is improved when both of the tips are aligned (or offset in a controlled manner) and are maintained in contact with the opposing sides of the sheet. However, in conventional tools and methods for double sided incremental forming, the coordinated motion of the two tools can sometimes lead to situations where the contact between the support tool and work piece is lost because of errors originating from assumptions made during simulation, variation in machine stiffness, slight mismatch between predicted and actual sheet thickness at a given point when subjected to deformation, etc. This affects the quality and accuracy of the finished part.

One approach is to deform the workpiece with the forming and support tool essentially clamping the workpiece and moving together under displacement control. This approach essentially squeezes and stretches the material in- and out-of plane and attempts to achieve the desired shape. However the resulting damage and lack of accuracy makes it an unviable approach. There is a desire to address these issues of conventional tools and methods for double sided incremental forming.

SUMMARY

One aspect is directed to a tool for double sided incremental forming of a workpiece. The tool comprises a sleeve comprises a first end and a second end and with a hollow interior space that extends into the sleeve from the first end. A mount is positioned at the second end of the sleeve. A spring is positioned within hollow interior space of the sleeve. A contact member comprises a working tip and an opposing end. The opposing end of the contact member is positioned within the interior space of the sleeve and the working tip is positioned outward beyond the sleeve to contact against the workpiece. The contact member is biased outward away from the sleeve by the spring. Bearing members act on the contact member and provide for rotational and translational movement of the contact member relative to the mount.

In another aspect, the bearing members comprise a translational bearing mounted to the sleeve and having an opening through which the contact member extends, and the translational bearing comprising a plurality of rollers that contact against the contact member and provide for the translational movement of the contact member relative to the sleeve.

In another aspect, the bearing members comprise a ball bearing operatively connected to the sleeve to provide for rotation of the sleeve relative to the mount.

In another aspect, each of the mount, the sleeve, the spring, and the contact member are coaxially aligned along a longitudinal axis of the tool.

In another aspect, the spring is a coil spring with a helical shape that extends around the opposing end of the contact member.

In another aspect, the working tip of the contact member comprises a spherical shape.

In another aspect, one of the bearing members is fixedly mounted within the interior space of the sleeve and remains fixed relative to the sleeve during the translational movement of the contact member within the sleeve.

In another aspect, a pin extends through the contact member and through the sleeve with the pin configured to move with the contact member relative to the sleeve during the translational movement of the contact member and to prevent the contact member from moving out of the interior space of the sleeve.

One aspect is directed to a tool for double sided incremental forming of a workpiece. The tool comprises a sleeve with a hollow interior space. A mount is connected to the sleeve. A contact member is positioned in the interior space of the sleeve with the contact member comprising a working end configured to contact against the workpiece. A spring is positioned within hollow interior space of the sleeve to bias the contact member in a direction outward from the interior space to maintain the working end of the contact member in contact with the workpiece. A first bearing member is operatively connected to the contact member and provides translational movement of the contact member relative to the mount. A second bearing member is operatively connected to the contact member and provides rotational movement of the contact member relative to the mount.

In another aspect, the first bearing member is mounted to the sleeve and positioned to contact against the contact member.

In another aspect, the first bearing member comprises a cylindrical shape that is coaxially aligned with the sleeve and the first bearing member further comprises a plurality of rollers that extend outward from an inner surface of the first bearing member and contact against the contact member.

In another aspect, both of the first bearing member and the second bearing member are positioned within the mount.

In another aspect, the mount comprises a shaft configured to be engaged by a tool holder and the mount further comprises a base that extends from the shaft and that supports the second bearing member with the shaft comprising a smaller width than the base.

In another aspect, slots extend along an axial section of the sleeve, and a pin extends through the contact member and through the slots with the pin sized to slide along the slots during the translational movement of the contact member along the sleeve and to prevent the contact member from moving out of the interior space of the sleeve.

In another aspect, the sleeve comprises a first end that is open and in communication with the hollow interior space and the sleeve further comprises an opposing second end that is closed and with the spring positioned in the hollow interior space at the closed second end.

In another aspect, the spring is a coil spring with a helical shape that extends around an opposing end of the contact member that is positioned within the interior space.

One aspect is directed to a method of using a tool during double sided incremental forming of a workpiece. The method comprises: biasing a working tip of the tool against a first side of the workpiece while the tool is mounted in a first tool holder; positioning a second tip of a second tool against an opposing second side of the workpiece while the second tool is mounted in a second tool holder; concurrently moving the first tool holder and the second tool holder relative to the workpiece with the second tip and the working tip remaining directly aligned while contacting the opposing sides of the workpiece; and translating and rotating the working tip relative to a remainder of the tool while moving the working tip in unison with the second tip.

In another aspect, the method comprises biasing the working tip relative to the remainder of the tool and maintaining the working tip in contact against the first side of the workpiece with the working tip biased outward away from the first tool holder.

In another aspect, the method further comprises translating a contact member that comprises the working tip along a sleeve that extends around the contact member while moving the working tip along the first side of the workpiece.

In another aspect, the method further comprise rotating the contact member relative to the sleeve while moving the working tip along the first side of the workpiece.

The features, functions and advantages that have been discussed can be achieved independently in various aspects or may be combined in yet other aspects, further details of which can be seen with reference to the following description and the drawings.

DETAILED DESCRIPTION

Figure 1:
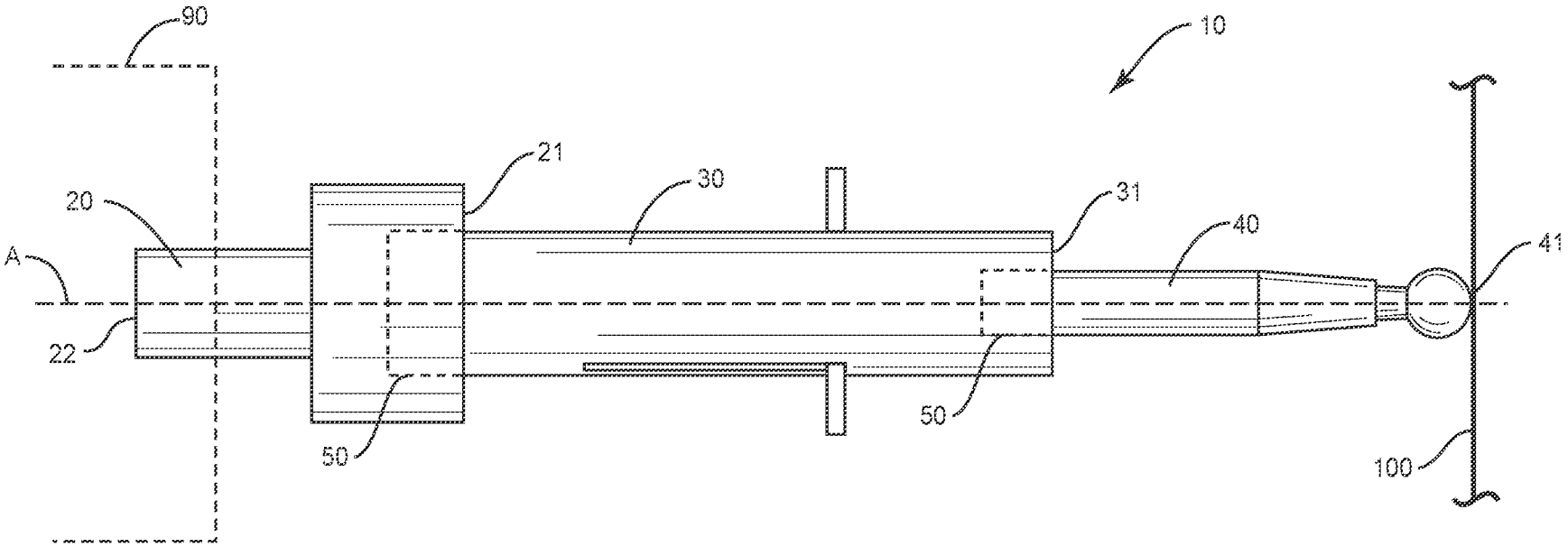
FIG. 1 is perspective view of a tool for double sided incremental forming, according to an example embodiment.

FIG. 1 illustrates a tool 10 for use during double sided incremental forming of a workpiece 100. The tool 10 includes a sleeve 30 with a hollow interior space. A contact member 40 is positioned within the hollow interior space of the sleeve 30. The contact member 40 is sized with a working tip 41 positioned outward beyond the sleeve 30 to contact against a workpiece 100. A mount 20 is positioned on the opposing end of the sleeve 30 and configured to connect to a tool holder 90. One or more bearing members 50 are mounted in the tool 10. The tool 10 is configured to provide for translational movement of the contact member 40 relative to the sleeve 30 along a longitudinal axis A of the tool 10. The contact member 40 is also rotatable about the longitudinal axis A relative to the mount 20 (and the attached tool holder 90). The axial and rotational movement of the contact member 40 provides for the working tip 41 to remain in contact with the workpiece 100 during the forming process. This configuration accommodates axial and transverse tendencies of the tool 10 to misalign and lose contact with the workpiece 100 during the forming process.

Figure 2:
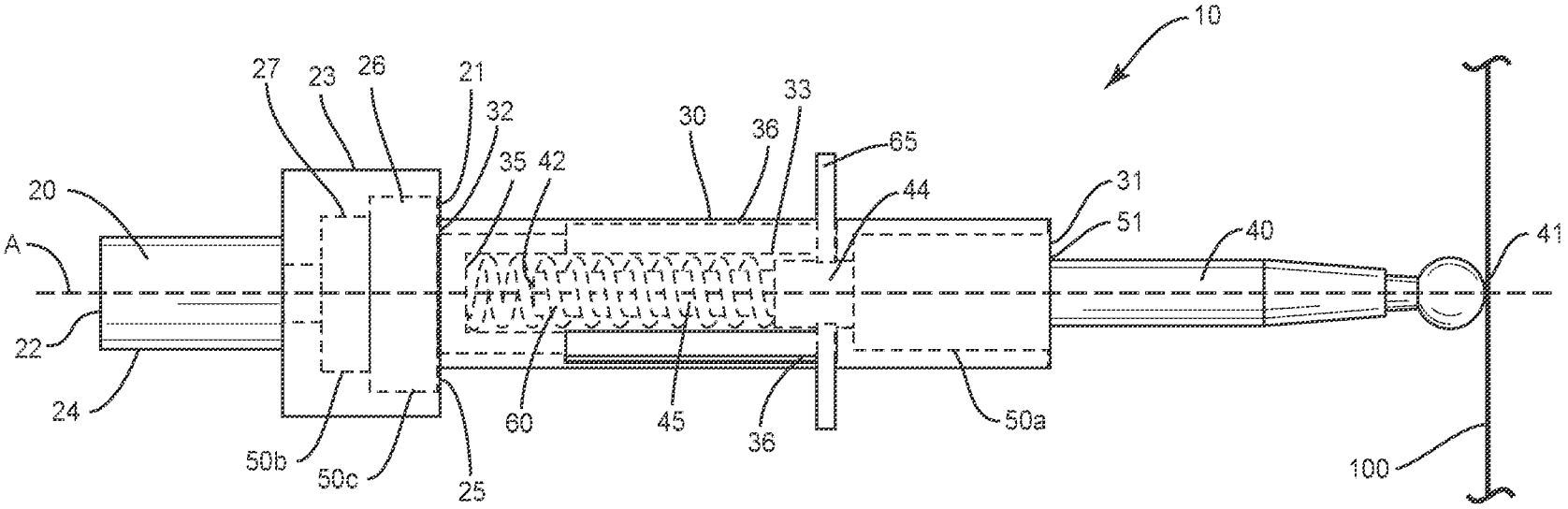
FIG. 2 is a schematic side section view of a tool for double sided incremental forming, according to an example embodiment.
Figure 3:
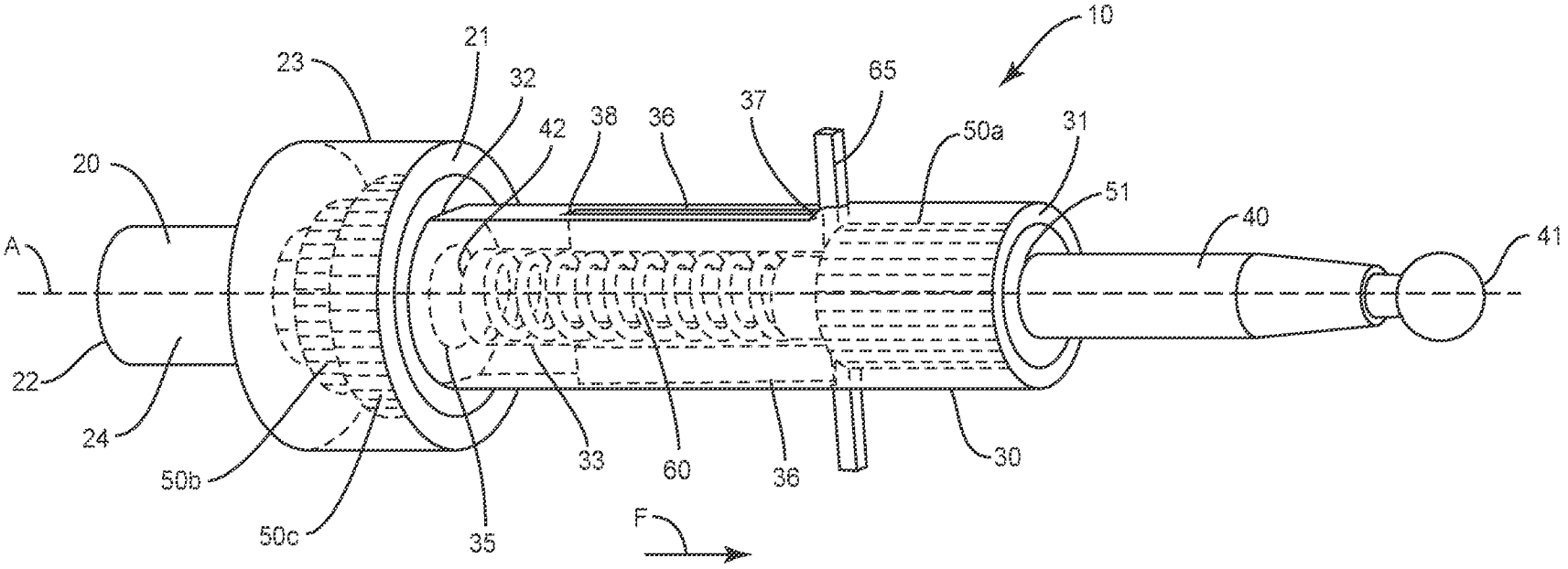
FIG. 3 is a schematic perspective section view of a tool for double sided incremental forming, according to an example embodiment.

FIGS. 2 and 3 illustrate schematic section views of the tool 10. The tool 10 includes a mount 20, sleeve 30, contact member 40, one or more bearing members 50*a*, 50*b*, 50*c*, and a spring 60. In one example, these components are co-axially aligned along a longitudinal axis A of the tool 10. In another example, one or more of these components is offset from the longitudinal axis A.

The mount 20 is configured to engage with the tool holder 90. The mount 20 includes a first end 21 that faces towards the sleeve 30 and an opposing second end 22. The first end 21 includes a base 23 and the second end 22 includes a shaft 24. The base 23 supports the sleeve 30 and the shaft 24 includes a smaller width than the base 23 measured across the longitudinal axis A. This larger size provides for contacting and supporting the sleeve 30 and/or positioning one or more bearing members 50.

In one example as illustrated in FIGS. 2 and 3, a cavity 25 extends into the base 23 from the first end 21. The cavity 25 includes a first section 26 at the first end 21, and an axial inward second section 27. In another example, the first end 21 is flat and forms a contact surface for the sleeve 30. In another example, the first end 21 includes a protrusion that extends axially outward and away from the shaft 24. The protrusion is sized to fit within an interior of the support the base 23.

The sleeve 30 extends outward from the first end 21 of the mount 20. The sleeve 30 includes an elongated length measured between a first end 31 and opposing second end 32. An interior space 33 is formed within the sleeve 30. The first end 31 is open and in communication with the hollow interior space 33. In one example, the interior space 33 extends the entire length of the sleeve 30 (i.e., the sleeve 30 is a cylinder). The second end 32 is closed and includes a bottom 35 to provide a support surface for the spring 60. The bottom 35 can be formed in various different manners. In one example, the bottom 35 is formed by a plug that is inserted into the interior space 33 at the second end 32. In another example, the hollow interior space 33 extends a limited distance inward from the first end 31 of the sleeve 30.

Slots 36 extend through the hollow interior space 33 from opposing lateral sides of the sleeve 30. The slots 36 are positioned axially inward from the ends 31, 32 of the sleeve 30. The slots 36 can have various lengths measured between opposing ends 37, 38.

The sleeve 30 can include a rounded exterior sectional shape. In another example, one or more axial sections are flat. In one specific example as best illustrated in FIG. 3, the axial sections of the exterior surface are flat along the slots 36.

The contact member 40 is movably positioned within the sleeve 30. The contact member 40 includes an elongated shape with a working tip 41 and an opposing end 42. In one example, the length of the contact member 40 is greater than the length of the sleeve 30. This size difference provides for the working tip 41 to extend outward beyond the sleeve 30 with the opposing end 42 positioned within the interior space 33 of the sleeve 30. The contact member 40 is offset within the sleeve 30 to position the working tip 41 outward beyond the first end 31 of the sleeve 30.

The working tip 41 contacts against the workpiece 100 during the forming process. In one example as illustrated in FIG. 2, the working tip 41 includes a spherical shape. In another example, the working tip 41 includes a tapered shape. The working tip 41 can include various shapes, sizes and configurations, including but not limited to rounded, pointed, and flat. The working tip 41 can have various surface finishes, including but not limited to smooth and textured.

In one example, the contact member 40 has a unitary one-piece construction. In another example, the contact member 40 is constructed from two or more sections that are connected together. As illustrated in FIG. 2, the contact member 40 includes a front section 44 and a rear section 45. The front section 44 includes the working tip 41 and the rear section 45 includes the opposing end 42. The front and rear sections 44, 45 can be connected together in various manners, including but not limited to a threaded connection, mechanical fasteners, and adhesives. In one specific example, the rear section 45 is threaded into a cavity in the front section 44.

A spring 60 biases the contact member 40 along the longitudinal axis A in a direction of arrow F in FIG. 3. The spring 60 is positioned at the bottom 35 of the interior space 33 and is configured to engage with a contact member 40. In one example, spring 60 is a coil spring that includes a helical shape with coils that are sized to wrap around the lower portion of the contact member 40 at the opposing end 42. The lower portion of the contact member 40 can include threads to facilitate the engagement. In another example, the spring 60 contacts just against the opposing end 42 and is positioned away from the remainder of the contact member 40.

Figure 4:
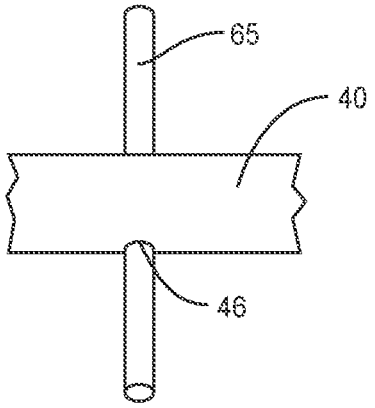
FIG. 4 is a partial perspective view of a pin that extends through a contact member, according to an example embodiment.

As illustrated in FIG. 4, an opening 46 extends through the width of the contact member 40. A pin 65 extends through the opening 46. The pin 65 is larger than the width of the contact member 40 and extends outward from the opposing lateral sides. As illustrated in FIGS. 2 and 3, the pin 65 also extends through the slots 36 in the sleeve 30. The pin 65 maintains the contact member 40 within the sleeve 30 as the contact member 40 is biased outward in the direction of arrow F in FIG. 3.

The tool 10 includes one or more bearing members 50 that provide for one or more of rotational and translational movement of the contact member 40. The one or more bearing members 50 provide for the working tip 41 of the contact member 40 to remain in contact with the workpiece during the forming process.

Figure 5:
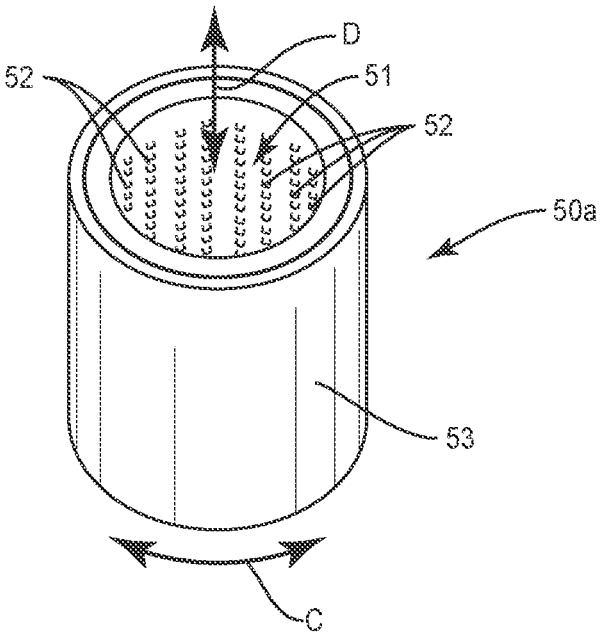
FIG. 5 is a perspective view of a bearing member, according to an example embodiment.

In one example, a bearing member 50*a* is connected to the sleeve 30 and positioned in the interior space 33. As illustrated in FIGS. 2 and 3, the bearing member 50*a* can be positioned at the first end 31 of the sleeve 30. The bearing member 50*a* provides for rotational and translational movement of the contact member 40. As illustrated in FIG. 5, the bearing member 50*a* includes a cylindrical body 53 with a hollow interior space 51 that extends the length. The bearing member 50*a* includes an outer diameter sized to fit into the interior space 33 of the sleeve 30. The bearing member 50*a* includes an inner diameter sized to receive the contact member 40. In one example, the diameter of the interior space 51 is substantially the same as the outer diameter of the contact member 40. This similar size supports the contact member 40 and limits the amount of lateral movement of the contact member 40. Rollers 52 are mounted along the inner surface of the interior space 51. The rollers 52 extend outward beyond the inner edge of the cylindrical body 53. The rollers 52 are rotatable relative to the cylindrical body 53 to provide for the contact member 40 to have rotational movement indicated by arrow C and axial movement indicated by arrow D. The rollers 52 can include various shapes, including but not limited to a spherical shape and a cylindrical shape.

One or more bearing members 50 can be positioned in the mount 20. As illustrated in FIGS. 2 and 3, bearing members 50*b* and 50*c* are positioned in the mount 20 and support the sleeve 30. Bearing member 50*c* is mounted within the first section 26 of the cavity 25 and bearing member 50*b* is mounted in the second section 27 of the cavity 25. The bearing members 50*b*, 50*c* support the sleeve 30 and allow rotational movement of the sleeve 30 relative to the mount 20. In one example as illustrated in FIGS. 2 and 3, bearing member 50*c* contacts against the second end 32 of the sleeve 30. The bearing member 50*b* contacts against the bearing member 50*c*. In one example, one of the bearing members 50*b*, 50*c* is a thrust bearing and the other is a ball bearing. The thrust bearing permits translational movement between the sleeve 30 (and the contact member 40) and the mount 20. The ball bearing provides rotational movement between the sleeve 30 (and contact member 40) and the mount 20. In one specific example, bearing member 50*b* is a thrust bearing and bearing member 50*c* is a ball bearing. In one example, a bearing member 50*a* is mounted in the sleeve 30 and provides for rotational and translational movement of the contact member 40. Bearing member 50*a* can include roller bearings 52 that contact the contact member 40 and provide for the movement.

Figure 6:
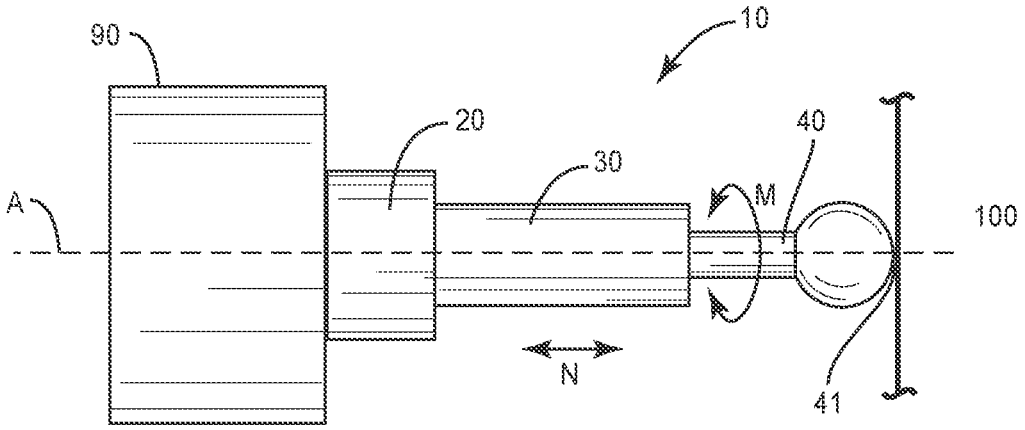
FIG. 6 is a side schematic view of a tool positioned against a workpiece.

FIG. 6 schematically illustrates a tool 10 that includes a longitudinal axis A. The mount 20, sleeve 30, and contact member 40 are coaxially aligned along the longitudinal axis A. The mount 20 of the tool 10 is engaged with a tool holder 90. The tool holder 90 provides for movement of the tool 10 relative to the workpiece 100 and applies a force for the contact member 40 to deform the workpiece 100. The tool 10 is configured for the contact member 40 to remain in contact with the workpiece 100 during the movement of the tool holder 90. As the contact member 40 slides along the workpiece 100, the tool 10 provides for rotational movement (arrow M) around the longitudinal axis A relative to the tool holder 90. The rotational movement is provided by the contact member 40 rotating within the bearing member 50*a* and/or the sleeve 30 and connected contact member 40 rotating with one or both of the bearing members 50*b*, 50*c*. The tool 10 also provides for translational movement (arrow N) of the contact member 40 along the longitudinal axis A. The translational movement of the contact member 40 within the sleeve 30 is provided through spring 60 positioned within the interior space 33 of the sleeve 30.

Figure 7:
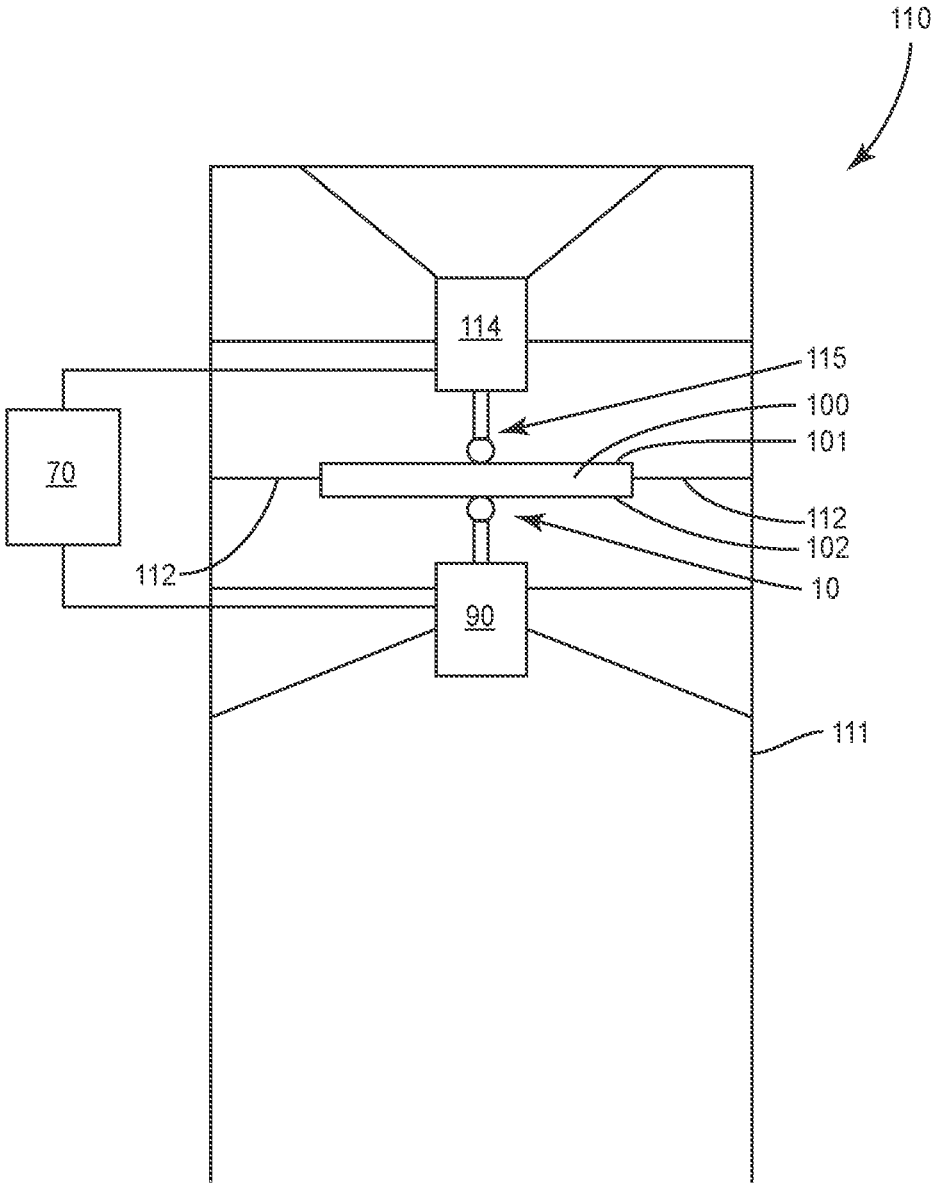
FIG. 7 is a side schematic view of a forming system that includes a tool mounted in a tool holder.

FIG. 7 illustrates a system 110 for using the tool 10 for double sided incremental forming on a workpiece 100. The workpiece 100 is rigidly mounted to a frame 111 with one or more clamps 112. The clamps 112 prevent movement of the workpiece 100 during the forming process. The clamps 112 are further positioned away from the areas of the workpiece 100 that will be contacted during the forming process.

First and second tool holders 90, 114 are attached to the frame 111. The first tool holder 90 is positioned on a first side 101 of the workpiece 100, and the second tool holder 114 is positioned on an opposing second side 102 of the workpiece 100. The tool 10 is attached to the first tool holder 90. In one example, the attachment includes the mount 20 of the tool 10 being engaged within a spindle of the tool holder 90. A second tool 115 is attached to the second tool holder 114. In one example, the second tool holder 114 is the same as the first tool holder 90 and provides for similar rotational and axial movement of the second tool 115. In another example, the second tool holder 114 includes a different structure than the tool holder 90.

The first and second tool holders 90, 114 are movable relative to the workpiece 100. In one example, the first and second tool holders 90, 114 provide movement in multiple degrees of freedom including three translational and one rotational. The first and second tool holders 90, 114 can include heating elements that provide for heating the workpiece 100 through the contact with the tools 10, 115. One or both of the first and second tool holders 90, 114 can also provide for rotation of the tools 10, 115 respectively.

Figure 8:
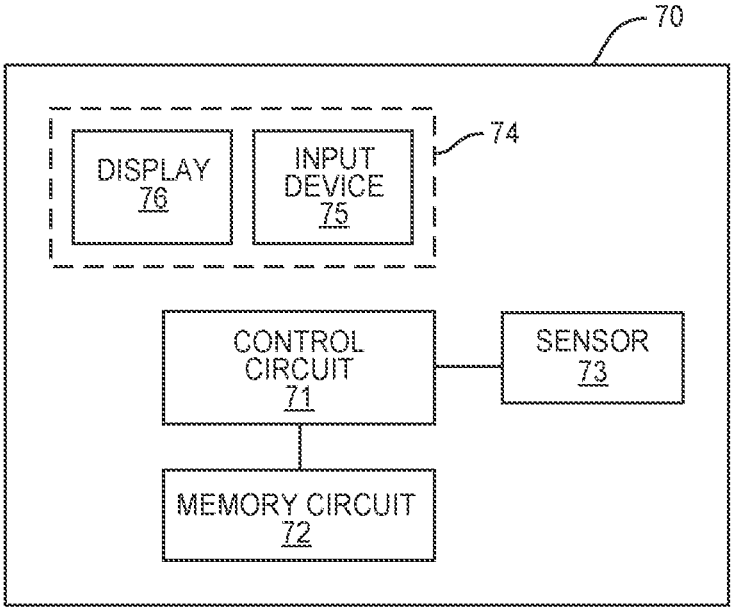
FIG. 8 is a schematic diagram of a controller of a forming system.

A control unit 70 controls the forming process and the operation of the tool holders 90, 114. As illustrated in FIG. 8, the control unit 70 includes a control circuit 71 and a memory circuit 72. The control circuit 71 controls overall operation of the forming process according to program instructions stored in the memory circuit 72. The control circuit 71 can include one or more circuits, microcontrollers, microprocessors, hardware, or a combination thereof. Memory circuit 72 includes a non-transitory computer readable storage medium storing program instructions, such as a computer program product, that configures the control circuit 71 to implement one or more of the techniques discussed herein. Memory circuit 72 can include various memory devices such as, for example, read-only memory, and flash memory. Memory circuit 72 can be a separate component as illustrated in FIG. 7, or can be incorporated with the control circuit 71. Alternatively, the control circuit 71 can omit the memory circuit 72, e.g., according to at least some embodiments in which the control circuit 71 is dedicated and non-programmable.

A user interface 74 provides for a user to control one or more aspects of the forming process. The user interface 74 can include one or more input devices 75 such as but not limited to a keypad, touchpad, roller ball, and joystick. The one or more input devices 75 provide for a user to enter commands to the control circuit 71. The user interface 74 can also include one or more displays 76 for displaying information to the user. One or more sensors 73 detect aspects of one or more of the tool holders 90, 114 and/or workpiece 100.

Figure 9:
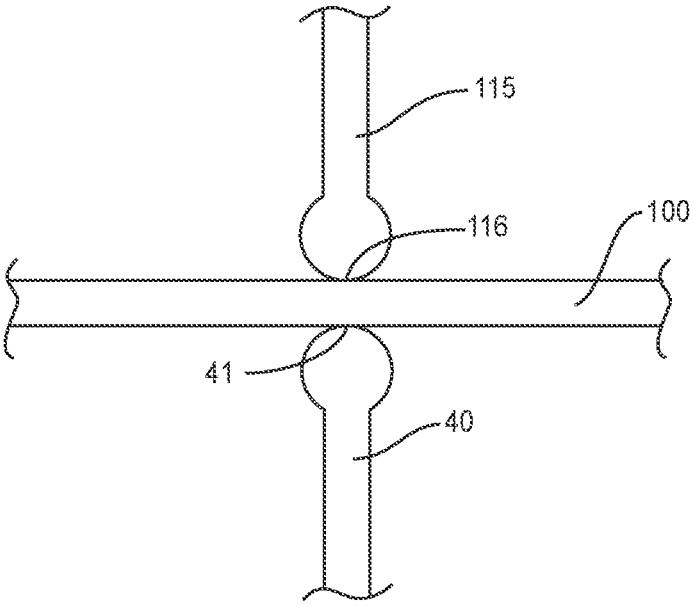
FIG. 9 is a side schematic view of a working tip a tool contacting against a first side of a workpiece and a tip of a second tool contacting against an opposing side of the workpiece.

The system 110 provides for double sided incremental forming of the workpiece 100. This process includes the workpiece 100 being formed into a desired geometry by a series of small incremental deformations. The forming process includes the working tip 41 of tool 10 and tip 116 of second tool 115 contacting against the opposing sides of the workpiece 100. As illustrated in FIG. 9, the working tip 41 of the contact member 40 of the tool 10 contacts the workpiece 100 on a first side, and the tip 116 of the second tool 115 contacts the workpiece 100 on the opposing side.

Prior to forming, a lubricant can be applied to the surfaces of the workpiece 100 to reduce friction with the tips 41, 116. Once the tips 41, 116 are aligned, the tool holders 90, 114 are moved about the workpiece 100. During forming, the tips 41, 116 move in unison and remain aligned or offset depending on the local geometric characteristic of the feature being formed.

During the forming process, the working tip 41 is maintained in contact with the first side of the workpiece 100. During the movement, friction between the working tip 41 and the workpiece 100 is reduced by the functional aspects of the tool 10. The ability of the contact member 40 to rotate and translate about the longitudinal axis A relative to the tool holder 90 accommodates axial and transverse tendency of the working tip 41 to misalign and lose contact with the workpiece 100. The tool 10 also reduces and/or prevents loss of contact of the working tip 41 during movement of the tool 10 and tool holder 90. The tool 10 also ensures appropriate stiffness levels by incorporation of the spring 60 with the desired stiffness without squeezing of the workpiece 100. This functionality accounts for mismatches and errors resulting from inaccurate estimates (algorithm software machine characteristics) as well as variations relating to machine and work piece compliance, specimen size, tool length, wear and tear, drift in machine performance etc.

Figure 10:
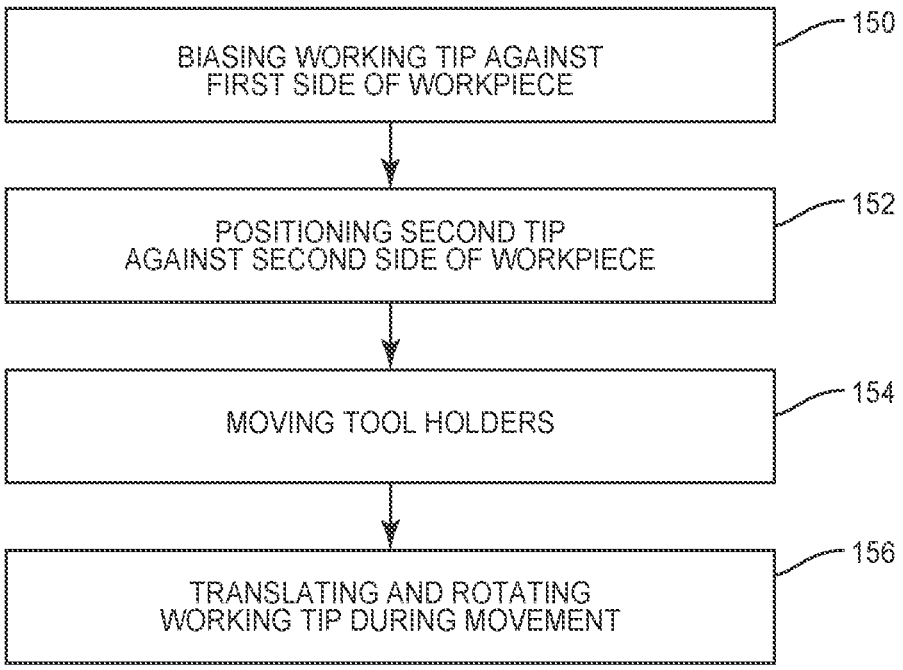
FIG. 10 is a flowchart diagram of a method of using a tool during double sided incremental forming of a workpiece.

FIG. 10 includes a method of using a tool 10 during double sided incremental forming of a workpiece 100. The method includes biasing the working tip 41 of the tool 10 against a first side of the workpiece 100 while the tool 10 is mounted in a first tool holder 90 (block 150). A second tip 116 of a second tool 115 is positioned against an opposing second side of the workpiece 100 (block 152). The second tool 115 is mounted in a second tool holder 114. At any instant, the working tip 41 and the second tip 116 can be aligned or offset depending on the local geometric characteristic feature. The first tool holder 90 and the second tool holder 114 move in a synchronized manner relative to the workpiece 100 with the second tip 116 and the working tip 41 remaining aligned/offset depending on the local geometric characteristic of the feature being formed while contacting the opposing sides of the workpiece 100 (block 154). In one example, the first tool holder 90 and the second tool holder 114 concurrently move relative to workpiece 100 with the second tip 116 and the working tip 41 remaining directly aligned while contacting the opposing sides 101, 102 of the workpiece 100. During the movement of the tool 10, the working tip 41 is translating and rotating relative to a remainder of the tool 10 (block 156). During this movement, the second tip 116 moves in a predefined path without translational motion during forming because the second tip 116 is functioning as the forming tool). This movement of the working tip 41 occurs while moving the working tip 41 in unison with the second tip 116. The tool tips 41, 116 swap their roles based on the local geometric characteristic of the feature being formed.

In one example, the tool 10 is used as the forming tool during the forming process and the second tool 115 follows and supports the workpiece 100 during the process. In another example, the tool 10 is used for support and the tool 115 is used for forming. In another example, the tools 10, 115 are used for both the forming and support tools.

In one example during the forming, the working tip 41 is biased relative to the remainder of the tool 10 and the working tip 41 is maintained in contact against the first side 101 of the workpiece 100 with the working tip 41 biased outward away from the first tool holder 90.

In one example, the method includes translating the contact member 40 that includes the working tip 41 along a sleeve 30 that extends around the contact member 40 while moving the working tip 41 along the first side 101 of the workpiece 100. This can further include rotating the contact member 40 relative to the sleeve 30 while moving the working tip 41 along the first side 101 of the workpiece 100.

The workpiece 100 can be constructed from various materials. Examples include but are not limited to metal, metal alloy, polymeric material, and combinations thereof.

By the term "substantially" with reference to amounts or measurement values, it is meant that the recited characteristic, parameter, or value need not be achieved exactly. Rather, deviations or variations, including, for example, tolerances, measurement error, measurement accuracy limitations, and other factors known to those skilled in the art, may occur in amounts that do not preclude the effect that the characteristic was intended to provide.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A tool for double sided incremental forming of a workpiece, the tool comprising:

a sleeve comprising a first end and a second end and with a hollow interior space that extends into the sleeve from the first end, the sleeve further comprising slots on opposing sides;

a mount positioned at the second end of the sleeve;

a spring positioned within hollow interior space of the sleeve;

a contact member with a working tip and an opposing end, the opposing end of the contact member positioned within the interior space of the sleeve and with the working tip positioned outward beyond the sleeve to contact against the workpiece, the contact member biased outward away from the sleeve by the spring, the working tip having a rounded shape and extending outward beyond the sleeve such that just the working tip contacts against the workpiece during the double sided incremental forming of the workpiece;

a pin that is connected to and that extends across the contact member, the pin further extending through the slots in the sleeve to maintain the contact member within the sleeve;

bearing members that act on the contact member and provide for rotational and translational movement of the contact member relative to the mount.

2. The tool of claim 1, wherein the bearing members comprise a translational bearing mounted to the sleeve and having an opening through which the contact member extends, the translational bearing comprising a plurality of rollers that contact against the contact member and provide for the translational movement of the contact member relative to the sleeve.

3. The tool of claim 2, wherein the bearing members comprise a ball bearing operatively connected to the sleeve to provide for rotation of the sleeve relative to the mount.

4. The tool of claim 1, wherein each of the mount, the sleeve, the spring, and the contact member are coaxially aligned along a longitudinal axis of the tool.

5. The tool of claim 1, wherein the working tip of the contact member comprises a spherical shape.

6. The tool of claim 1, wherein one of the bearing members is fixedly mounted within the interior space of the sleeve and remains fixed relative to the sleeve during the translational movement of the contact member within the sleeve.

7. The tool of claim 1, wherein the pin is configured to move with the contact member relative to the sleeve during the translational movement of the contact member and to prevent the contact member from moving out of the interior space of the sleeve.

8. The tool of claim 1, wherein the contact member comprises a unitary one-piece construction.

9. A tool for double sided incremental forming of a workpiece, the tool comprising:

a sleeve with a hollow interior space;

a mount connected to the sleeve;

a contact member positioned in the interior space of the sleeve, the contact member comprising an elongated body that includes a working end with a rounded shape configured to contact against the workpiece;

a spring positioned within hollow interior space of the sleeve to bias the contact member in a direction outward from the interior space to maintain the working end of the contact member in contact with the workpiece;

a pin that is connected to and that extends outward from the contact member, the pin extends through the sleeve and outward beyond the sleeve to maintain the contact member within the sleeve as the contact member is biased outward from the interior space;

a first bearing member operatively connected to the contact member that provides translational movement of the contact member relative to the mount; and a second bearing member operatively connected to the contact member that provides rotational movement of the contact member relative to the mount;

the contact member extending outward beyond a remainder of the tool such that just the working end contacts against the workpiece during the double sided incremental forming of the workpiece.

10. The tool of claim 9, wherein the first bearing member is mounted to the sleeve and positioned to contact against the contact member.

11. The tool of claim 10, wherein the first bearing member comprises a cylindrical shape that is coaxially aligned with the sleeve, the first bearing member further comprises a plurality of rollers that extend outward from an inner surface of the first bearing member and contact against the contact member.

12. The tool of claim 9, wherein both of the first bearing member and the second bearing member are positioned within the mount.

13. The tool of claim 9, wherein the mount comprises a shaft configured to be engaged by a tool holder, the mount further comprises a base that extends from the shaft and that supports the second bearing member with the shaft comprising a smaller width than the base.

14. The tool of claim 9, further comprising:

slots that extend along an axial section of the sleeve; and the pin extends through the contact member and through the slots, the pin sized to slide along the slots during the translational movement of the contact member along the sleeve and to prevent the contact member from moving out of the interior space of the sleeve.

15. The tool of claim 9, wherein the sleeve comprises a first end that is open and in communication with the hollow interior space, the sleeve further comprises an opposing second end that is closed and with the spring positioned in the hollow interior space at the closed second end.

16. The tool of claim 9, wherein the spring is a coil spring with a helical shape that extends around an opposing end of the contact member that is positioned within the interior space.

17. A method of using a tool during double sided incremental forming of a workpiece, the method comprising:

locating the tool on a first side of the workpiece with the tool having a sleeve that extends around a contact member and with a working tip of the contact member located outward beyond the sleeve;

biasing the working tip of the contact member of the tool against a first side of the workpiece while the tool is mounted in a first tool holder and with just the working tip of the tool contacting against the workpiece during the double sided incremental forming;

contacting a pin that extends outward from the contact member through slots in the sleeve and contacting the pin against edges of the slots and maintaining the contact member within the sleeve while biasing the working tip against the first side of the workpiece;

positioning a second tip of a second tool against an opposing second side of the workpiece while the second tool is mounted in a second tool holder;

concurrently moving the first tool holder and the second tool holder relative to the workpiece with the second tip and the working tip remaining directly aligned while contacting the opposing sides of the workpiece; and moving the body of the contact member through a cylindrical bearing member and translating and rotating the body and the working tip together and relative to a remainder of the tool while moving the working tip in unison with the second tip and while preventing the remainder of the tool from contacting the workpiece.

18. The method of claim 17, further comprising biasing the working tip relative to the remainder of the tool and maintaining the working tip in contact against the first side of the workpiece, the working tip biased outward away from the first tool holder.

19. The method of claim 17, further comprising translating the contact member along a sleeve that extends around the contact member while moving the working tip along the first side of the workpiece.

20. The method of claim 19, further comprising rotating the contact member relative to the sleeve while moving the working tip along the first side of the workpiece.

* * * * *